US006641032B1

(12) United States Patent
Schilling

(10) Patent No.: US 6,641,032 B1
(45) Date of Patent: Nov. 4, 2003

(54) STACKABLE CONTAINER WITH REINFORCED CORNER

(75) Inventor: Johan H. Schilling, Ontario, CA (US)

(73) Assignee: Fruit Growers Supply Company, Ontario, CA (US)

( * ) Notice: Subject to any disclaimer, the term of this patent is extended or adjusted under 35 U.S.C. 154(b) by 0 days.

(21) Appl. No.: 10/142,853

(22) Filed: May 8, 2002

(51) Int. Cl.[7] ..... B65D 21/032

(52) U.S. Cl. ..... 229/174; 206/509; 229/191; 229/918

(58) Field of Search ..... 229/174, 177, 229/178, 179, 191, 915, 918, 919; 206/509, 512

(56) References Cited

U.S. PATENT DOCUMENTS

| | | | | | |
|---|---|---|---|---|---|
| 2,163,117 | A | * | 6/1939 | Evans et al. | 229/919 |
| 2,594,628 | A | * | 4/1952 | Evans | 229/915 |
| 3,734,392 | A | | 5/1973 | Clark | |
| 3,946,934 | A | | 3/1976 | Chaffers | |
| 4,134,533 | A | | 1/1979 | Heavner | |
| 4,151,948 | A | * | 5/1979 | de la Fuente, Jr. | 206/512 |
| 4,770,339 | A | | 9/1988 | Weimer | 229/143 |
| 5,002,224 | A | | 3/1991 | Muise | 229/169 |
| 5,294,044 | A | | 3/1994 | Clark | 229/191 |
| 5,429,296 | A | | 7/1995 | Southwell | 229/168 |
| 5,452,848 | A | | 9/1995 | Mur Gimeno | 229/191 |
| 5,501,395 | A | * | 3/1996 | McElroy | 229/919 |
| 5,535,941 | A | | 7/1996 | Garza | 229/191 |
| 5,649,663 | A | | 7/1997 | Pestow, Jr. | 229/190 |
| 5,860,590 | A | | 1/1999 | Blomfield | 229/165 |
| 6,131,805 | A | | 10/2000 | Gasior | 229/174 |
| 6,138,904 | A | | 10/2000 | Baird | 229/149 |
| 6,270,009 | B1 | | 8/2001 | Heeren | 229/178 |
| 6,296,178 | B1 | * | 10/2001 | McKenna, Sr. | 229/174 |
| 6,302,323 | B1 | * | 10/2001 | Southwell | 229/915 |
| 6,443,358 | B1 | * | 9/2002 | Schilling | 229/174 |
| 6,460,758 | B1 | * | 10/2002 | Fenton et al. | 229/915 |
| 6,481,619 | B1 | * | 11/2002 | Jackson | 229/918 |

FOREIGN PATENT DOCUMENTS

| | | | | |
|---|---|---|---|---|
| EP | 588751 A1 | * | 3/1994 | 229/915 |
| FR | 2651482 A1 | * | 3/1991 | 229/919 |

* cited by examiner

*Primary Examiner*—Gary E. Elkins
(74) *Attorney, Agent, or Firm*—Sheppard, Mullin, Richter & Hampton LLP

(57) ABSTRACT

A stackable container formed from a unitary blank pre-cut and pre-scored with an improved design directed at providing material cost savings while achieving stacking stability and related benefits. The container includes a base with two sets of opposing walls. The first set of walls each include a first panel attached at a lower edge to the base and a second panel attached at an upper edge to the first panel and thereby forming at least one stacking tab having a two-ply thickness. The second set of opposing walls each include an outer panel attached to the base; two center flaps, each attached to the corresponding side edge of the first panel thereby forming a corner; and two inner flaps, each attached the corresponding center flap. The container further includes four reinforcement panels, each attached to the adjacent side edge of the corresponding second panel.

13 Claims, 5 Drawing Sheets

STACKABLE CONTAINER WITH REINFORCED CORNER

BACKGROUND OF THE INVENTION

This invention relates to stackable containers and, more particularly, stackable containers formed from pre-cut and pre-scored unitary blanks.

Typically, containers utilized in the storage, shipping, and display of produce, nuts, fruits, and the like are formed from unitary blanks. A unitary blank is formed by cutting and scoring a single sheet of corrugated paperboard or a similar material, i.e., a starting sheet, with a predetermined pattern to enable the blank to be folded to form a container. In use, the containers are loaded with the selected product and are stacked upon each other. Thus, it is advantageous for such containers to be securely stackable. However, difficulties can arise in stacking several fully-loaded containers. For example, the accumulated weight may cause damage to containers at the bottom of the stack, such as, collapsing a corner. Also, the containers may not properly align causing the stack to bias in a particular direction and potentially to fall over. A variety of stackable containers are known in the art, incorporating stacking tabs and reinforcing structures. Yet, many containers incorporating such features are relatively difficult to construct, requiring several steps to fully assemble.

In many applications for stackable containers, it is customary for such containers to be manufactured in one located and assembled in another. Thus, it is further advantageous for such containers to assemble easily. Furthermore, such containers do not optimize the use of materials, and some stackable containers require the integration of several blanks for full assembly, rather than attaining the benefits of unitary blank assembly.

It should, therefore, be appreciated there is a need of an improved container formed of a unitary blank having reinforced corners and stacking tabs with improved stacking strength and stability, which employs efficient usage of sheet material and assembles with relative ease while improving cost-effectiveness. The present invention fulfills this need and others.

SUMMARY OF THE INVENTION

The present invention is embodied in a stackable container utilized in the storage, shipping, and display of produce, nuts, fruits, and the like, formed from a unitary blank pre-cut and pre-scored with an improved design in which, once assembled, the container has enhanced stacking and strength attributes. Moreover, the improved design is such that more efficient use of the material is made. More particularly, the container includes a base with two sets of opposing walls. The first set of walls each include a first panel attached at a lower edge to the base and a second panel attached at an upper edge to the first panel and thereby forming at least one stacking tab having a two-ply thickness. The second set of opposing walls each include an outer panel attached to the base; two center flaps, each attached to the corresponding side edge of the first panel thereby forming a corner; and two inner flaps, each attached the corresponding center flap. The container further includes four reinforcement panels, each attached to the adjacent side edge of the corresponding second panel.

In a detailed aspect of a preferred embodiment of the invention, the side the second panels of the first set of walls are sized such that their side edges are positioned a selected distance away from the corner, and thereby the reinforcement panels are oriented in a triangular configuration with respect to the corresponding corners.

In another detailed aspect of a preferred embodiment of the invention, each inner flap is positioned a selected distance from the corresponding corner and the terminal edge of the corresponding reinforcement panel abuts the first side edge of the inner flap such that it locks in place.

Other features and advantages of the present invention will become apparent from the following description of the preferred embodiments, taken in conjunction with the accompanying drawings, which illustrate, by way of example, the principles of the invention.

BRIEF DESCRIPTION OF THE DRAWINGS

Embodiments of the present invention will now be described, by way of example only, with reference to the following drawings in which.

DESCRIPTION OF THE PREFERRED EMBODIMENTS

Figure 1:
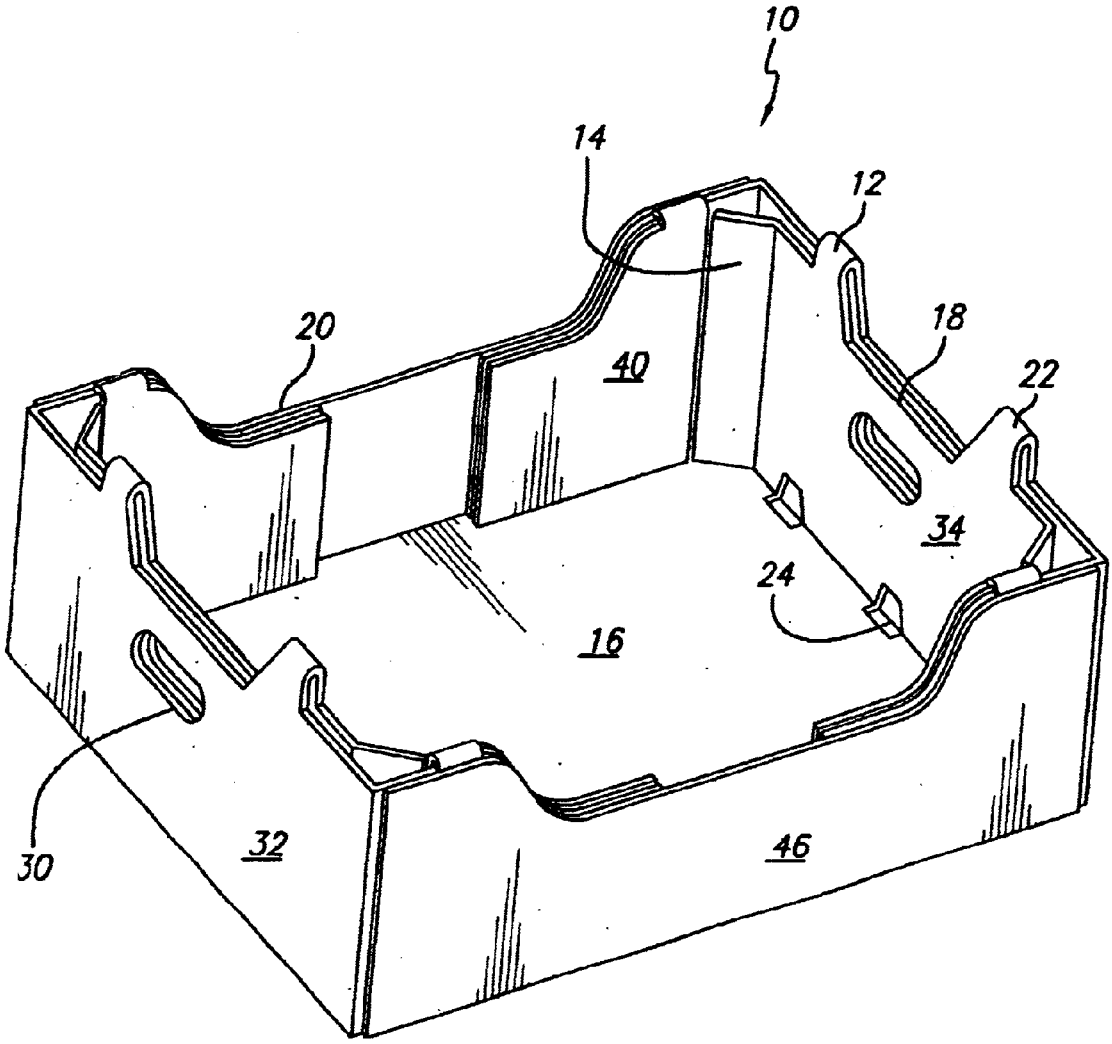
FIG. 1 is an elevated perspective view of a preferred embodiment of a container in accordance with this invention.

As shown in the exemplary drawings, the present invention is embodied in a stackable container formed from a unitary blank pre-cut and pre-scored with an improved design. With reference to FIG. 1 there is shown a stackable container 10 having stacking tabs 12 and reinforcement panels 14 for providing enhanced stacking and strength. Moreover, the container improves cost-effectiveness through efficient usage of sheet material and ease of assembly. It is noted that the present invention is not intended to be limited to the dimensions of the preferred embodiment depicted in the figures, e.g., other embodiments are envisioned with varied height-length-width ratios.

Figure 2:
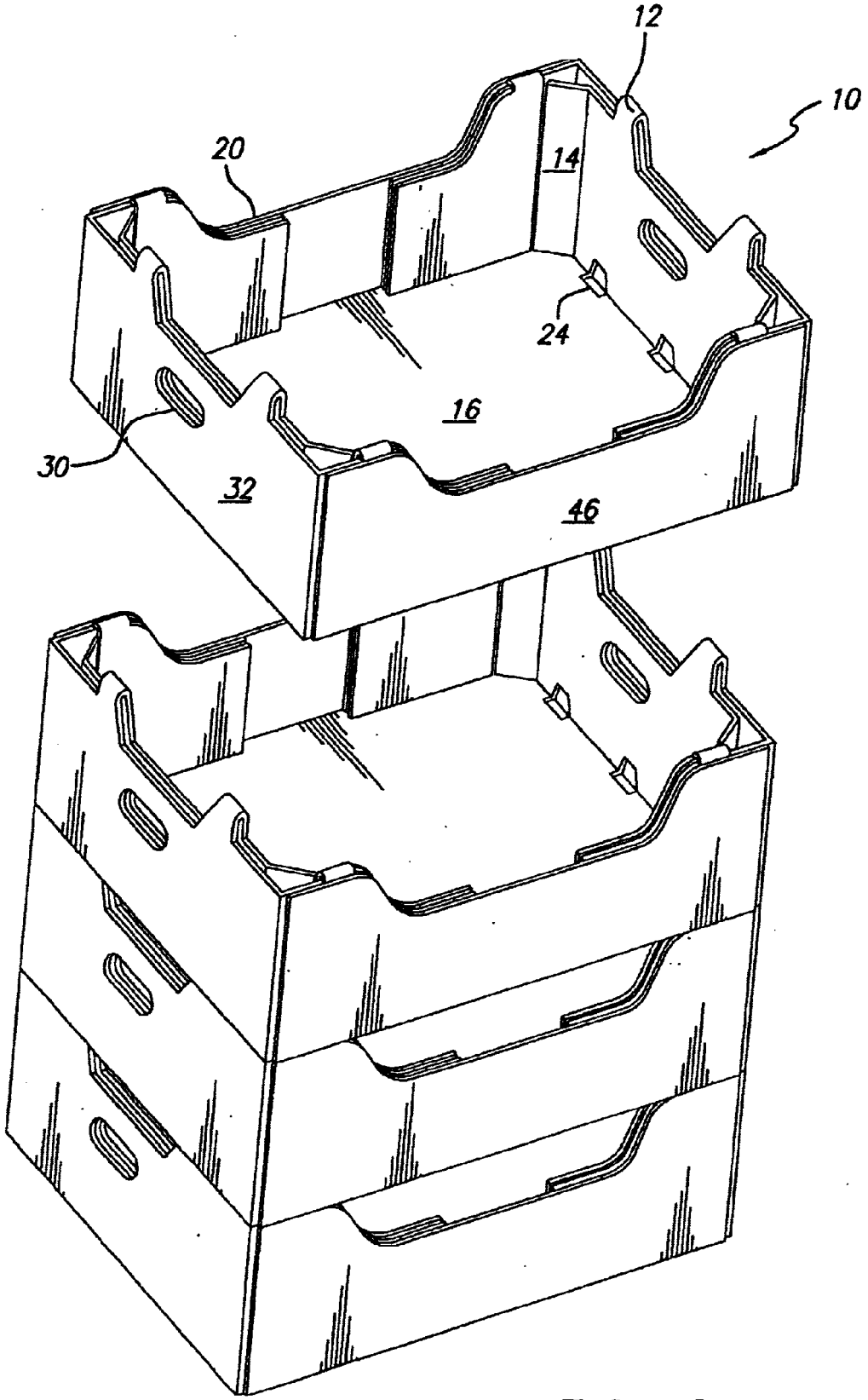
FIG. 2 is an elevated perspective view of a preferred embodiment of four assembled containers of FIG. 1, illustrating the manner in which the containers may be stacked.

With reference to FIGS. 1 and 2, the container 10 includes a rectangular base 16, end walls 18 and side walls 20. In this embodiment, the stacking tabs 12 are positioned in spaced relationship atop the end walls and are two-ply to enhance stacking stability. Each ply of a stacking tab is foldably joined at a single score line, crown score 22, thereby providing two-ply thickness and protecting against fraying of the stacking tab. In the present embodiment, four stacking tabs are shown, however, varying numbers of stacking tabs are contemplated. The rectangular base defines stacking slots 24 sized and aligned to receive stacking tabs from a second container, thereby facilitating proper alignment of the stacked containers (FIG. 2) without having the stacked containers tilt askew.

The reinforcement panels 14 are positioned in each corner of the container 10 and contribute to the container's enhanced stacking and strength attributes. The reinforcement panels effectively distribute the weight of the stacked containers, thereby preventing the accumulated weight of stacked containers to damage containers at the bottom of the stack, particularly at the corners of the container. They also facilitate proper alignment for stacked containers by providing a stable stacking surface to place an upper container upon. Beneficially, the reinforcement panels are configured to be assembled without need for additional steps, as is detailed further below.

Figure 3:
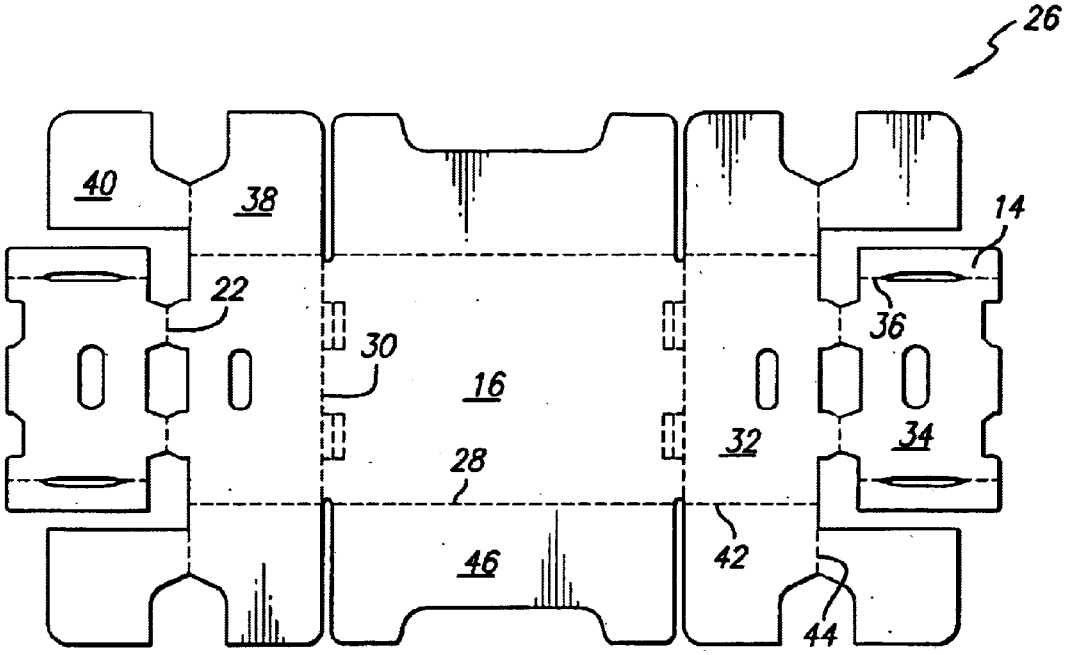
FIG. 3 is a planar view of a pre-cut and pre-scored blank from which the container of FIG. 1 is formed.

With reference to FIG. 3, there is shown is a planar view of a blank 26, formed from corrugated paperboard from which the stackable container 10 is assembled. A sheet of corrugated paperboard is cut and scored as indicated, with solid lines indicating cuts and dashed lines indicating scores, also known as bend or fold lines, to form the blank. For convenience of reference, panels and flaps forming the walls are referenced relative to one another with respect to the center of the container once assembled, e.g., inner, center, and outer. Preferably, the material used is corrugated paperboard, however, other materials which exhibit like characteristics may be used. The paperboard is oriented for cutting and scoring such that, once constructed, the corrugation lines within the stacking tabs 12 run perpendicular to the base to aid in stacking strength. Beneficially, the present invention provides that each wall has at least two plies of paperboard oriented with the corrugation lines running perpendicular to the base.

Figure 5:
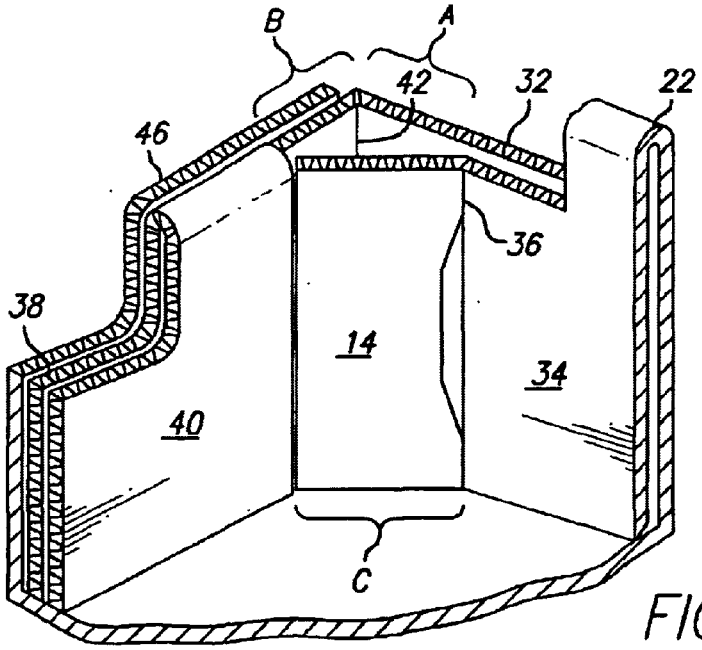
FIG. 5 is an enlarged elevated perspective view of a reinforced corner of the container of FIG. 1.

With continued reference to FIG. 3, the base 16 is bordered by single score lines, two opposing side score lines 28 and two opposing end score lines 30. The blank 26 also includes outer end panels 32 and inner end panels 34 which form the end walls 18. The outer end panels are attached at their respective lower edges to the end score lines of the base. The inner end panels have a shorter horizontal length than the outer panels by a selected distance (A) on each side (FIG. 5). The outer and inner end panels cooperatively form stacking tabs 12 and are attached to one another at the crown score of each stacking tab. In this embodiment, the end panels also define handles 30 (FIG. 1), which aid in the transportation of the container. The reinforcement panels 14 are attached to the side edges of the inner end panel by score line 36, and have a horizontal length (C) (FIG. 5).

The blank 26 further includes center side flaps 38 and inner side flaps 40. The center side flaps are attached by a single score line 42 to side edges of the outer end panel. The inner side flaps are attached to upper edges of the center sides flaps at score line 44, and are spaced a selected distance (B) from score line 42 (FIG. 5). Each side wall 20 is formed by two inner side flaps, two center side flaps, and an outer side panel 46. The outer side panels are attached at their respective lower edges to the side score lines 28 of the base 16.

Figure 4:
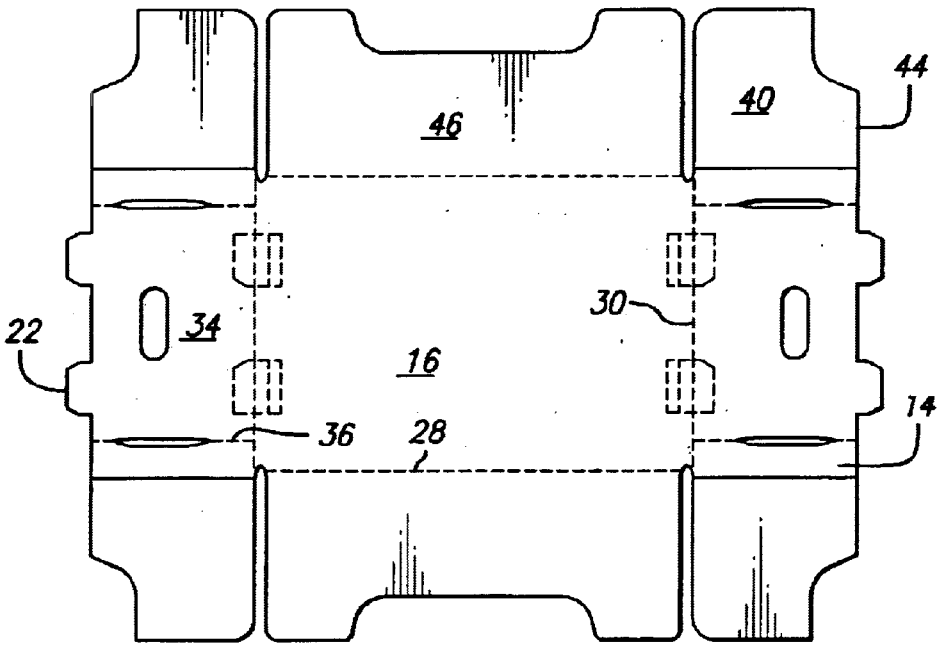
FIG. 4 is a planar view of a partially-assembled container of FIG. 1.

With reference to FIG. 4, there is shown a planar view of a partially-assembled container 10 formed from blank 26. First, in assembling the container, the inner end panels 34 are folded 180 degrees about crown scores 22 along with the inner side flaps which are folded 180 degrees about score lines 44. The inner flaps and the inner panels are secured in place by means commonly known in the art, e.g., staples, glue, tabs and slots, or tape. Optionally, the partially assembled container can be transported in at this stage of assembly, thereby reducing the number of steps and materials needed to complete assembly at the final destination. Next, the outer end panels 32 are folded 90 degrees about score lines 30. Then, the center side flaps 38 are folded 90 degrees about score lines 42, thereby causing the reinforcement panels to move into position abutting the adjacent edge of the inner side flap without need of any additional steps (FIG. 5). Preferably, the reinforcement panel will be securely positioned against the adjacent edge of the inner side flap such that it is secured in place, once the container is fully assembled. Thereafter, the outer side panels 46 are folded 90 degrees about fold line 28 and are secured to the side flaps 38, 40 by means commonly known in the art, e.g., staples, glue, tabs and slots, or tape. In this embodiment, the panels and flaps of the side walls are shaped to form a cut-out region, which aids in transport and display of loaded containers, however, other embodiments are envisioned without the cut-out region.

With reference to FIG. 5, there is shown an elevated perspective view of a reinforced corner of the container 10. As previously mentioned, the inner end panels 34 have a shorter horizontal length than the outer end panels 32 by a selected distance (A) on each side, the inner side flaps 40 are spaced a selected distance (B) from score line 42, and the reinforcement panels 14 have a horizontal length of (C). The distances A, B and C, are selected to position the reinforcement panel in a triangular configuration with respect to the corner, such that, once assembled, it abuts the adjacent edge of the inner side flap, thereby providing reinforcement panels without need for additional assembly steps. Preferably, distance A and distance B are approximately equal. In other embodiments, it is not necessary for the reinforcement panel to abut the adjacent edge of the inner side flap, rather the reinforcement panel may be positioned solely against the center side flap 38.

Figure 6:
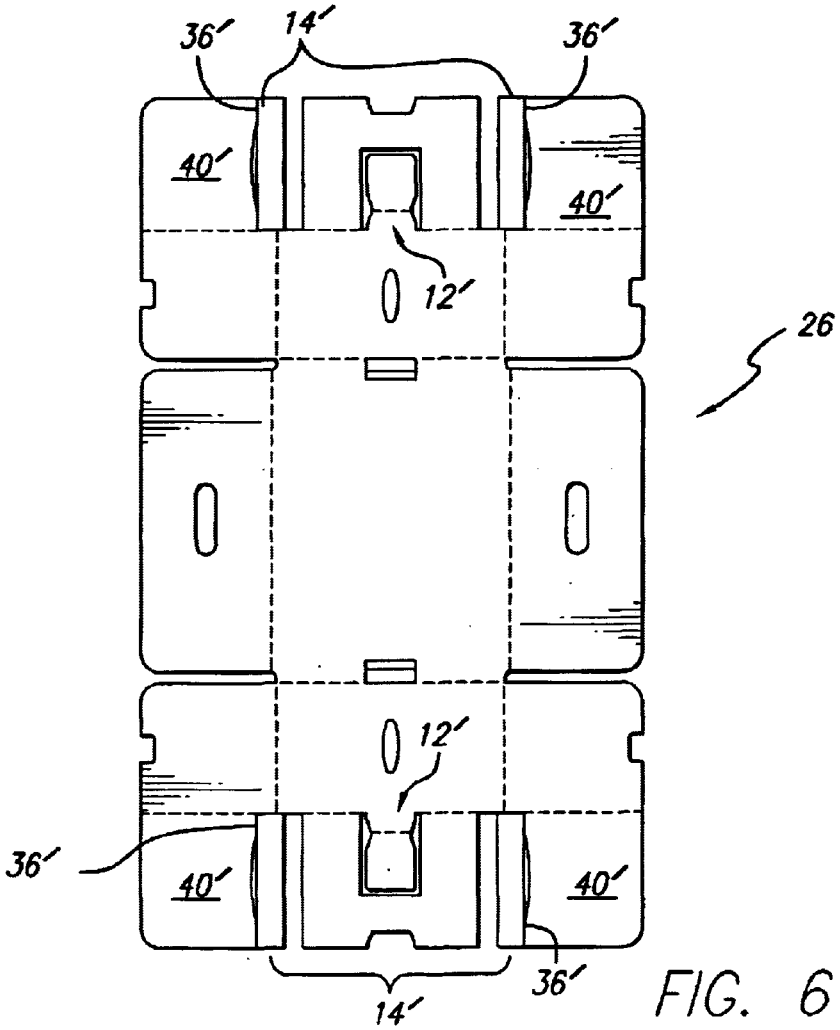
FIG. 6 is a planar view of a pre-cut and pre-scored blank from which a second preferred embodiment of a container in accordance with this invention is formed.

With reference to FIG. 6, there is shown a blank 26' having reinforcement panels 14' from which a second preferred embodiment is formed. In this embodiment, each panel 14' is attached to the corresponding side edge of an inner side flap 40' at score line 36'. In assembly, the side flaps are folding into place, thereby causing the reinforcement panels to move into position abutting or in close proximity to the adjacent edge of the respective inner end panel in the manner discussed above. Also, stacking tabs 12' cut out from the inner panel are provided.

Figure 7:
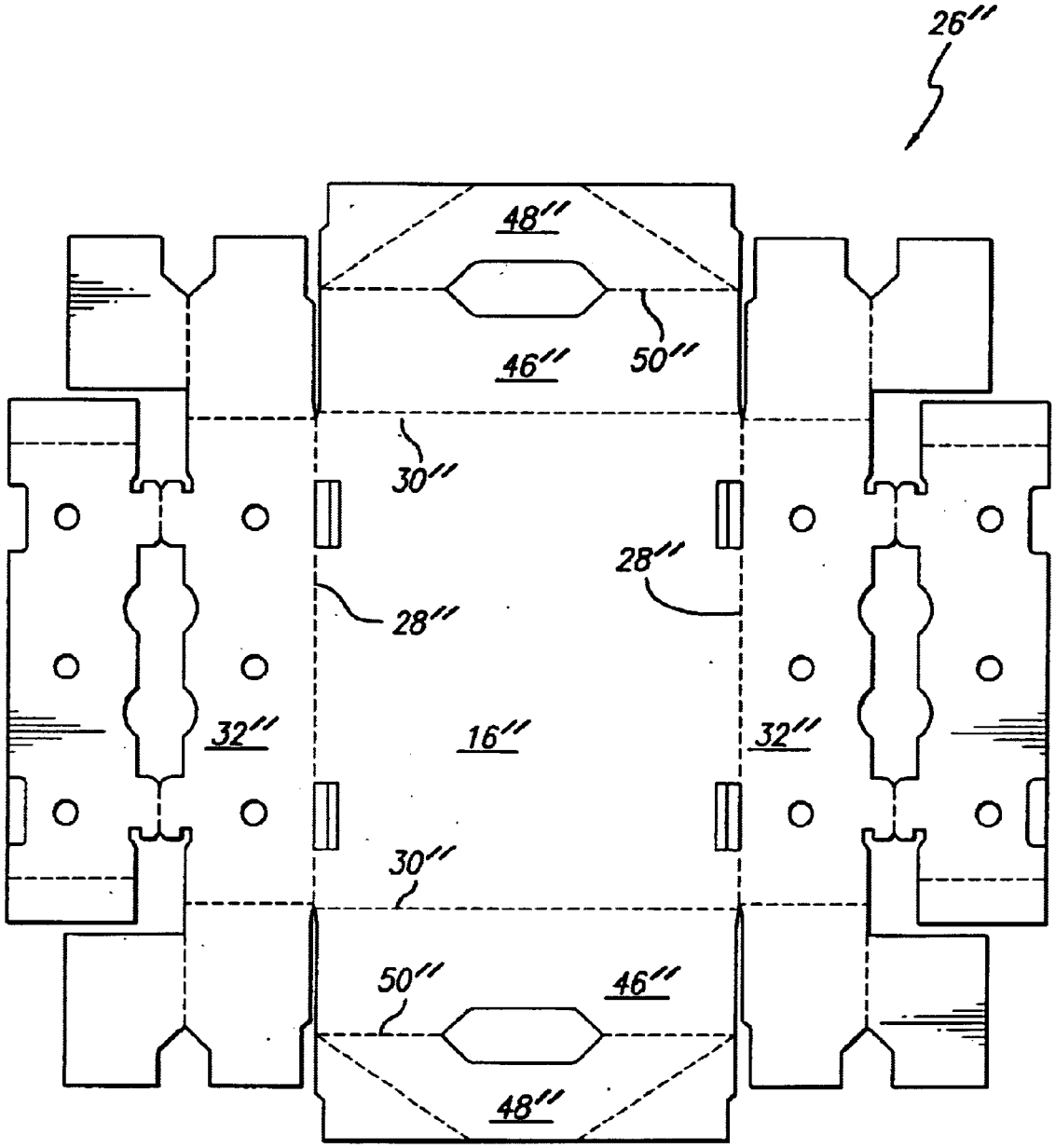
FIG. 7 is a planar view of a pre-cut and pre-scored blank from which a third preferred embodiment of a container in accordance with this invention is formed.

With reference to FIG. 7, there is shown a blank 26" from which a third preferred embodiment is formed. In this embodiment, outer end panels 32" foldably attached to corresponding major edges 28" of a base 16", and side panels 46" are foldably attached to corresponding minor edges 30" of the base. The blank further includes top flaps 48" attached to corresponding upper edges 50" of side panels. The top flaps can be configured to partially or fully enclose the container.

It should be appreciated from the foregoing description that the present invention provides a stackable container formed from a unitary blank pre-cut and pre-scored with an improved design directed at providing material cost savings while achieving stacking stability and related benefits. This is achieved, in part, by providing two-ply stacking tabs to facilitate proper alignment of the stacked containers and further providing reinforcement panels with improved strength and stacking characteristics which are configured to be assembled without need for additional steps.

While a particular form of the invention has been illustrated and described, it will be apparent that various modifications can be made without departing from the invention. Accordingly, the invention is to be defined only by the following claims.

I claim:

1. A reinforced corner for a container formed from a single blank, the corner comprising:

a rectangular base having a first edge and a second edge perpendicular to the first edge;

a first wall having a first panel, having a lower edge, an upper edge, and a side edge, attached at the lower edge by a fold line to the first edge of the base, a second panel with a lower edge adjacent to the base, an upper edge, and a side edge, and at least one stacking tab having a two-ply thickness and a fold line connecting the upper edge of the first panel and the upper edge of the a second panel;

a second wall having an outer panel with a lower edge attached by a fold line to the second edge of the base, a center flap having an upper edge and a side edge attached by a fold line to the side edge the first panel of the first wall, and an inner flap having an upper edge attached to the upper edge of the center flap by a fold line and a first side edge adjacent to the second panel of the first wall; and a reinforcement panel having an upper edge, a lower edge adjacent to the base, a terminal edge adjacent to the first side edge of the inner flap, and an attachment edge attached by a fold line to the side edge of the second panel of the first wall.

2. A reinforced corner as defined in claim 1, herein all fold lines are single fold lines.

3. A reinforced corner as defined in claim 1, wherein the first wall has a two-ply thickness and the second wall has a three-ply thickness.

4. A reinforced corner as defined in claim 1, wherein the inner flap is positioned a selected distance from the corner and the terminal edge of the reinforcement panel abuts the first side edge of the inner flap.

5. A reinforced corner as defined in claim 1, wherein the container is formed from corrugated paperboard and the corrugation lines within the first wall are substantially perpendicular to the base.

6. A reinforced corner as defined in claim 1, wherein the reinforcement panel is oriented in a triangular configuration with respect to the corner.

7. A container formed from a unitary blank, the container comprising:

a rectangular base having a first set of opposing base edges and a second set of opposing base edges;

a first set of opposing walls, each wall having a first panel, having a lower edge, an upper edge, and two opposing side edges, attached at the lower edge by a single fold line to the corresponding edge of the first set of base edges, a second panel with a lower edge adjacent to the base, an upper edge, and two opposing side edges, and at least one stacking tab having a two-ply thickness and a single fold line connecting the upper edge of the first panel and the upper edge of the second panel;

a second set of opposing walls, each wall having an outer panel with a lower edge attached by a single fold line to the corresponding edge of the second set of base edges, two center flaps, each having an upper edge and a side edge attached by a single fold line to the corresponding side edge of the first panel thereby forming a corner, and two inner flaps, each positioned a selected distance (B) from the corresponding corner and each having an upper edge attached by a single fold line to the upper edge of the corresponding center flap and a first side edge adjacent to the corner; and four reinforcement panels, each having an upper edge, a lower edge adjacent to the base, a terminal edge adjacent to the first side edge of the corresponding inner flap, and an attachment edge located a selected distance (C) from the terminal edge and attached by a single fold line to the adjacent side edge of the second panels of the first set of walls, wherein the side edges of the second panels are positioned a selected distance (A) from the corner.

8. A container as defined in claim 7, wherein the rectangular base has a length and a width, and wherein further the first set of opposing base edges are along the length of the base and the second set of opposing base edges are along the width of the base.

9. A container as defined in claim 7, wherein the rectangular base has a length and a width, and wherein further the first set of opposing base edges are along the width of the base and the second set of opposing base edges are along the length of the base.

10. A container as defined in claim 7, wherein the reinforcement panels are oriented in a triangular configuration with respect to the corresponding corner.

11. A container as defined in claim 7, wherein the selected distances (A) and (B) are approximately equal.

12. A container as defined in claim 7, the terminal edges of the reinforcement panels abut the corresponding first side edges of the inner flaps such that they are secured in place.

13. A container as defined in claim 7, further comprising two top flaps, each top flap foldably attached to the corresponding upper edge of the outer panels of the second set of walls.

* * * * *